US011472656B2

(12) United States Patent
Adami

(10) Patent No.: US 11,472,656 B2
(45) Date of Patent: Oct. 18, 2022

(54) CONVEYOR DEVICE FOR A CORRUGATED WEB, CORRUGATED BOARD MANUFACTURING LINE INCLUDING THE CONVEYOR DEVICE, AND METHOD

(71) Applicant: Guangdong Fosber Intelligent Equipment Co., Ltd., Foshan (CN)

(72) Inventor: Mauro Adami, Viareggio (IT)

(73) Assignee: Guangdong Fosber Intelligent Equipment Co., Ltd., Foshan (CN)

( * ) Notice: Subject to any disclaimer, the term of this patent is extended or adjusted under 35 U.S.C. 154(b) by 691 days.

(21) Appl. No.: 16/515,262

(22) Filed: Jul. 18, 2019

(65) Prior Publication Data

US 2020/0031604 A1 Jan. 30, 2020

(30) Foreign Application Priority Data

Jul. 27, 2018 (EP) ..... 18185955

(51) Int. Cl.

*B65H 20/02* (2006.01)
*B65H 27/00* (2006.01)
*B31F 1/28* (2006.01)

(52) U.S. Cl.

CPC ..... *B65H 20/02* (2013.01); *B31F 1/2845* (2013.01); *B65H 27/00* (2013.01); *B31F 1/2831* (2013.01); *B65H 2301/11* (2013.01); *B65H 2301/4474* (2013.01); *B65H 2301/5122* (2013.01); *B65H 2404/15* (2013.01); *B65H 2701/1762* (2013.01)

(58) Field of Classification Search

CPC ..... B65H 20/02; B65H 2301/5122; B65H 2301/11; B65H 2404/15; B65H 2701/1762; B65H 2301/4474; B31F 1/2845

See application file for complete search history.

(56) References Cited

U.S. PATENT DOCUMENTS 3,997,095 A 12/1976 Lamb
5,080,010 A * 1/1992 Ibuchi ..... B30B 3/04 100/168
5,676,790 A 10/1997 Burrows
5,951,454 A 9/1999 Adami
6,048,429 A * 4/2000 Cummings ..... B31F 1/2813 156/472
6,092,452 A 7/2000 Adami
6,165,117 A 12/2000 Adami
6,684,749 B2 2/2004 Adami
8,342,068 B2 1/2013 Adami
8,714,223 B2 5/2014 Adami et al.

(Continued)

FOREIGN PATENT DOCUMENTS

EP 0109257 A3 5/1984
EP 0979727 A3 2/2000

(Continued)

*Primary Examiner* — Jeremy R Severson
(74) *Attorney, Agent, or Firm* — Breiner & Breiner, L.L.C.

(57) ABSTRACT

A conveyor device for conveying a single face corrugated web on a bridge is disclosed. The conveyor device includes a lower guide roller, around which the single face corrugated web is guided. The conveyor device further includes an upper pinching and conveyance nip formed by a pair of nip members in pressure contact with one another. At least one of the nip members is motor-driven. The pinching and conveyance nip is configured to pull the single face corrugated web upwards from the lower guide roller.

18 Claims, 11 Drawing Sheets

(56) References Cited

U.S. PATENT DOCUMENTS

| | | | | |
|---|---|---|---|---|
| 2004/0089394 | A1 | 5/2004 | Guilmartin et al. | |
| 2004/0177912 | A1 | 9/2004 | Burrows | |
| 2007/0039495 | A1 * | 2/2007 | Sakamoto ..... | B65H 23/12<br>101/228 |

FOREIGN PATENT DOCUMENTS

| | | | |
|---|---|---|---|
| EP | 1362691 | B1 | 8/2006 |
| WO | 2017036685 | A1 | 3/2017 |

* cited by examiner

CONVEYOR DEVICE FOR A CORRUGATED WEB, CORRUGATED BOARD MANUFACTURING LINE INCLUDING THE CONVEYOR DEVICE, AND METHOD

TECHNICAL FIELD

Disclosed herein is a conveyor device for conveying a single face corrugated web from a single facer to a bridge. Also disclosed herein is a corrugated board manufacturing line including a single facer, a double facer, a bridge to convey single face corrugated web from the single facer to the double facer, as well as a conveyor device which lifts the single face corrugated web from the single facer to the bridge.

BACKGROUND ART

For manufacturing corrugated board, plants comprising one or more single facers are used. Two paper webs are fed to each single facer. A first paper web is corrugated in the single facer between a first corrugating roller and a second corrugating roller. The first, corrugated web is glued to the second, smooth paper web by means of a pressure device, for example a belt or a roller. A so-called single face corrugated web is thus obtained, which is composed of a fluted web and a smooth web, wherein the flutes of the fluted web are glued to the smooth web. The single face corrugated web is fed, along with a third smooth paper web, to a so-called double facer or double backer, which comprises a series of hot plates where the single face corrugated web is glued to the third smooth paper web so as to form a double-wall corrugated board.

In some plants more single facers are provided, each of which produces a single face corrugated web. Several single face corrugated webs can be simultaneously fed to the double backer or double facer, together with the third smooth paper web, to produce a composite corrugated board, comprised of a plurality of fluted webs each sandwiched between a pair of smooth webs.

The corrugated board exiting the double facer is subsequently trimmed to remove longitudinal edge trims, and fed to a slitter-scorer, where the corrugated web is slit into a plurality of longitudinal strips, each of which can be scored along one or more scoring lines. The strips are subsequently transversely cut to form corrugated board sheets for producing boxes or other similar articles.

A bridge extends above the single facers towards the double facer. Each single face corrugated web delivered by each single facer is lifted from the respective single facer and conveyed on the bridge. Along the bridge conveyor endless belts or other conveyor means are arranged, to convey the single face corrugated webs towards the double facer.

A conveyor device is provided between each single facer and the bridge, to lift the respective single face corrugated web form the single facer and transfer it onto the bridge. In corrugated board manufacturing lines of the current art, the conveyor device usually includes two paired endless belts, pressed one against the other to grip the single face corrugated web and convey the web by friction from the single facer to the bridge. Exemplary embodiments of conveyor belt pairs are disclosed in U.S. Pat. No. 5,676,790, US 2004/0177912 and US 2004/0089394, for instance.

Large conveyor belts are difficult to control and may damage the single face corrugated web. When a new single face corrugated web has to be threaded through the conveyor device, an operator shall introduce the leading edge of the single face corrugated web between the paired belts. This operation is risky and can lead to injuries to the operator, especially if his hands are accidentally captured between the belts.

The applicant has developed a conveyor device comprised of a single belt, which extends from a lower guide roller to the bridge. This known device reduces the risks for the operator, but still needs improvement to alleviate problems concerning the guidance of large conveyor belts.

It would therefore be desirable to provide a conveyor device which overcomes or alleviates one or more of the drawbacks of the devices of the current art.

SUMMARY

A conveyor device for conveying a single face corrugated web on a bridge is disclosed, which comprises a lower guide roller, around which the single face corrugated web is guided; and an upper pinching and conveyance nip formed by a pair of nip members in pressure contact with one another, at least one of said nip members being motor-driven. The pinching and conveyance nip is configured to pull the single face corrugated web upwards from the lower guide roller.

The single face corrugated web can thus form a free span between the lower guide roller and the upper pinching and conveyance nip.

As will become apparent from the description of exemplary embodiments of the conveyor device of the present disclosure, the nip members are independent from the lower guide roller, in that there is no conveyor member, acting upon the single face corrugated web, extending therebetween and drivingly coupled thereto. In other words, there is no web conveyor belt extending from the lower guide roller to the upper nip members. This differs from the conveyor devices of the current art, where at least one, and more generally two co-acting conveyor belts extend from a lower guiding roller to an upper guiding roller, are entrained around at least one of said guiding rollers and are in surface contact with the single face corrugated web for drawing the single face corrugated web from the single facer to the bridge. As noted above, such wide belts are prone to malfunctioning and may lead to injuries to the personnel in charge of the operation of the machine.

Conversely, by providing a lower guide roller and an upper pair of nip members, which are separate from one another a free span of single face corrugated board is formed therebetween, which is guided around the lower guide roller and then freely moves up to the pair of nip members. Thus the above mentioned drawbacks of the current art conveyor devices are at least alleviated or overcome.

In particularly preferred embodiments, the pair of nip members comprises a pair of rollers, at least one of which and preferably both of which are motor-driven. In preferred embodiments, also the lower guide roller is motor-driven. A better traction and pulling action on the single face corrugated web can be obtained. The peripheral speed of the nip members and of the lower guide roller can be identical. However, in other embodiments, the speed of the nip members and of the lower guide roller can be such that the peripheral speed of the lower guide roller is lower (e.g. around 1-2% lower) than the peripheral speed of the nip members. Under some conditions this may result in better traction and guidance of the single face corrugated web.

According to particularly advantageous embodiments, in order to facilitate insertion of a leading edge of a single face corrugated board into the pinching and conveyance nip formed by the pair of nip members, the conveyor device can further comprise a corrugated web threading device adapted to thread a leading portion of a single face corrugated web into the pinching and conveyance nip.

In some embodiments, the threading device can be adapted to wrap the single face corrugated web around one of the nip members and guide the leading edge thereof into and through the nip.

The web treading device can comprise an endless member, such as a belt, driven along a closed path, for instance defined by threading or guiding rollers, which can preferably be supported for idle rotation. The closed path is adapted to take selectively an idle position and a web threading position, for instance by moving one or more of the axes of the threading rollers with respect to the nip members. In the idle position the endless member is clear of the nip members while in the web threading position the endless member is wrapped around at least one of said nip members and can take motion therefrom. The single face corrugated web is nipped between the endless threading member and the nip member and can be guided around this latter into and through the pinching and conveyance nip.

To further facilitate introduction of the leading portion of a single face corrugated web towards the pinching and conveyance nip, a stationary slide can be located between the lower guiding roller and the upper pinching and conveyance nip. The stationary slide can provide a sliding and guidance surface for the leading portion of the single face corrugated web at the start of the manufacturing process, when the leading edge of the web must be threaded through the pinching and conveyance nip. The threading device can be arranged along the stationary slide, which can be provided with a slot or aperture extending in the web advancing direction. The threading device can be caused to project from the slide through the aperture or slot towards the nip members, such that a leading portion of the web can be guided by the operator along the slide until contacting the threading device and eventually the nip members.

According to another aspect, disclosed herein is a corrugated web manufacturing line, comprising: at least a single facer; a double facer; a bridge extending from the single facer to the double facer, adapted to convey a single face corrugated web from the single facer to the double facer; and a conveyor device as set forth above, to lift a single face corrugated web from the single facer to the bridge.

According to yet another aspect, a method of operating a corrugated board manufacturing line is disclosed the method comprises the following steps:

continuously manufacturing a single face corrugated web in a single facer;

pulling the single face corrugated web from the single facer upwards onto a bridge by means of a conveyor device as set forth above, and in particular a conveyor device comprising: a lower guide roller; and an upper pinching and conveyance nip formed by a pair of nip members in pressure contact with one another, at least one of said nip members being motor-driven; wherein the single face corrugated web is lifted from the single facer to the bridge by action of at least said nip members;

advancing the single face corrugated web on the bridge towards a double facer.

Further features and embodiments of the conveyor device and of the method disclosed herein are described later on with reference to the enclosed drawings, and in the appended claims, which form an integral part of the description.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION OF EMBODIMENTS

Figure 1:
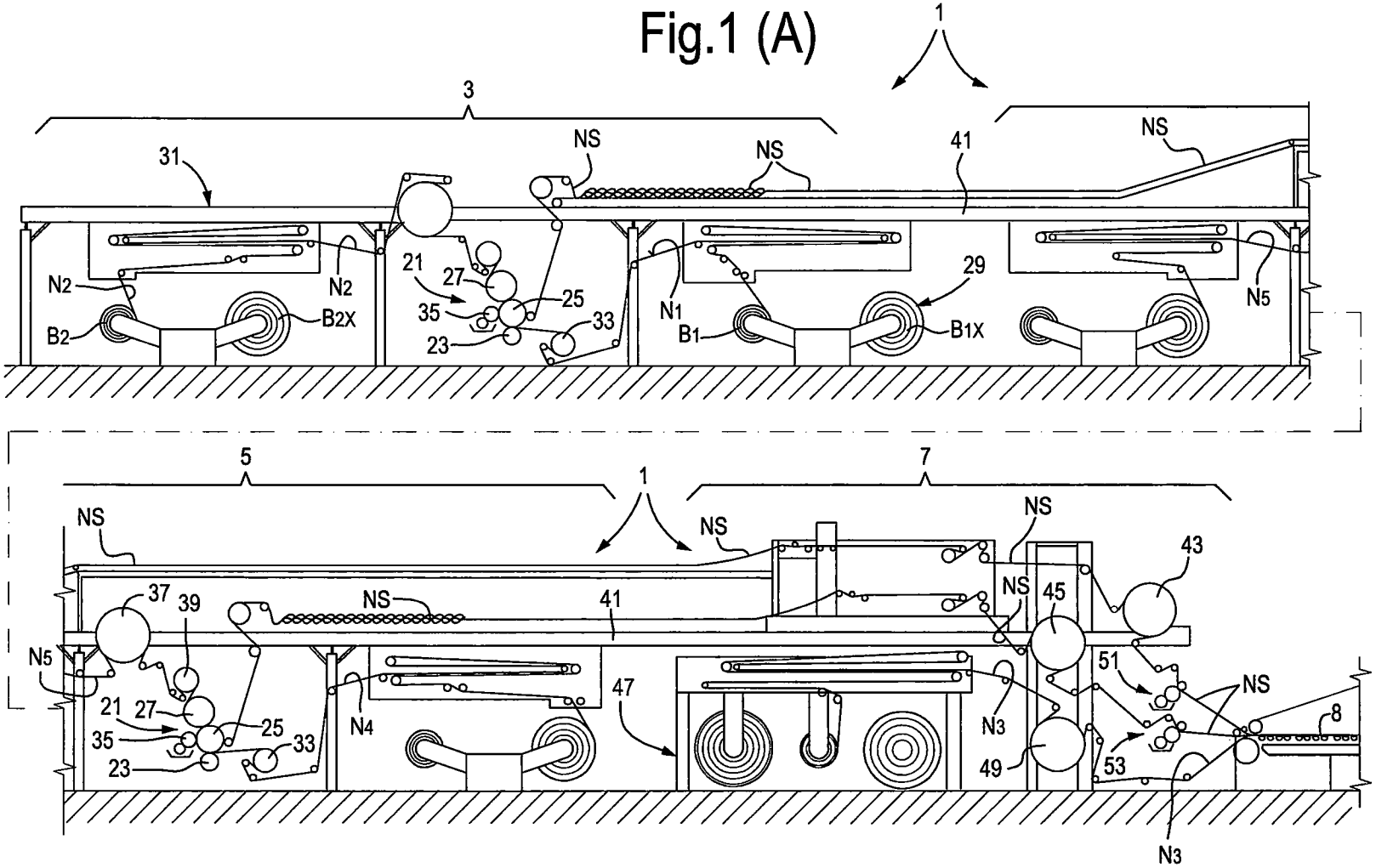
FIGS. 1A, 1B, 1C, 1D illustrate a corrugated board manufacturing line.
Figure 1:
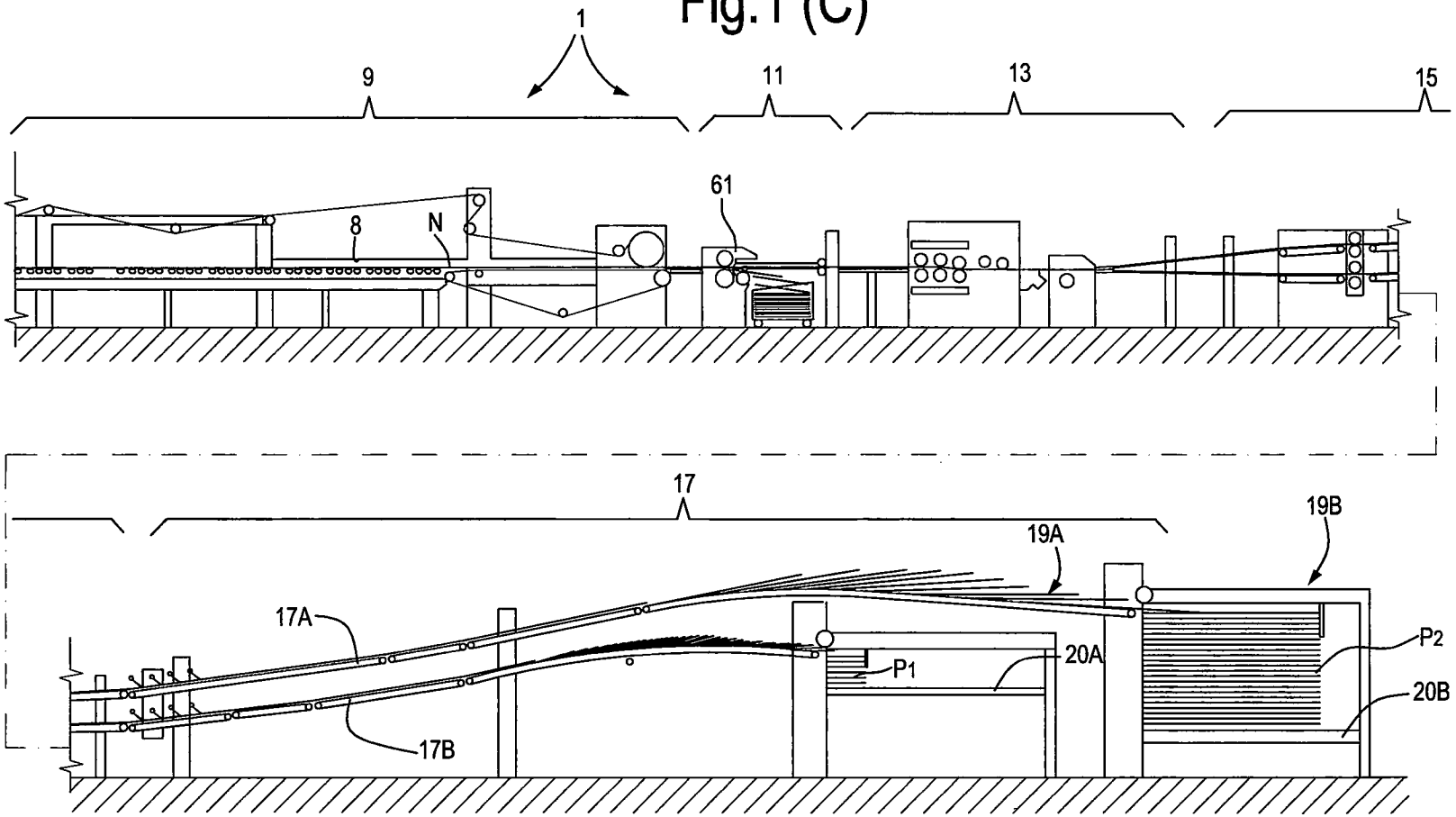

FIGS. 1A, 1B, 1C, 1D schematically illustrate an example of a corrugated board manufacturing line 1, which may include one or more conveyor devices according to the disclosure, to move single face corrugated webs from the single facer which manufactures them on a bridge which moves the single face corrugated web(s) towards a double facer. It shall be understood that in actual fact the various portions of the corrugated board manufacturing line depicted in FIGS. 1A, 1B, 1C, 1D are arranged in sequence one after the other in an upstream-downstream direction.

With reference to the illustrated embodiment, the corrugated board manufacturing line 1 comprises a first section 3, for the production of a first single face corrugated web, a second section 5 for the production of a second single face corrugated web, a third section 7 for feeding the two single face corrugated webs and a smooth paper web to a double backer or double facer 8 arranged in a double facer section 9.

The portions of the manufacturing line 1 mentioned so far form the so-called wet end. A continuous corrugated board N is delivered from the wet end to the so-called dry end of the manufacturing line 1.

The dry end comprises a trimming section 11, for removing trimmings from the corrugated board N. Downstream of trimming section 11, a section 13 is provided for longitudinally slitting and scoring the continuous corrugated board N to generate longitudinal strips and longitudinal edge trims which are removed. Each longitudinal strip can be scored along longitudinal scoring lines.

The manufacturing line 1 further comprises: a section 15 for transversely cutting the strips of corrugated board coming from section 13 into single sheets; a double conveyor 17 (17A, 17B); and two stackers 19A and 19B for stacking the corrugated board sheets into stacks P1, P2. Reference numbers 20A, 20B designate stacking platforms on which the stacks P1, P2 are formed.

In section 3, a first single facer 21 is arranged. Single facers adapted for producing a single face corrugated web are known in the art. Only the main elements of the single facer will be described hereunder. Exemplary embodiments of suitable single facers are disclosed in U.S. Pat. No. 8,714,223 or in EP 1362691, for instance.

Briefly, the single facer 21 (see the enlargement of FIG. 3) may comprise a first corrugating roller 23 co-acting with a second corrugating roller 25 and a pressure roller 27, or other pressure member, to bond a smooth paper web and a fluted paper web to one another, as described hereunder. A first smooth paper web N1 is fed to the single facer 21 from a first unwinder 29. The unwinder 29 may be configured in a known manner and will not be described in detail. The unwinder 29 may comprise two positions for a first reel B1, from which the first paper web N1 is supplied, and a second reel B1X standing by, which will be unwound when the reel B1 is exhausted.

A second smooth paper web N2 is unwound from a second unwinder 31, which can be similar or substantially identical to the unwinder 29, and onto which a first reel B2, from which the paper web N2 is unwound, and a second stand-by reel B2X are arranged, the stand-by reel B2X starting to be unwound when the reel B1 is exhausted.

The first smooth paper web N1 is fed to the corrugating roller 23, after having been passed around a heating roller 33. The first smooth paper web N1 is corrugated or fluted passing through the nip between the corrugating rollers 23 and 25. Onto the flutes formed on the corrugated paper web N1 glue (such as a starch-based glue) is applied by means of a gluing unit 35, so that the corrugated paper web N1 can be glued onto the smooth paper web N2 fed, together with the paper web N1, through the nip between the second corrugating roller 25 and the pressure roller 27.

Figure 2:
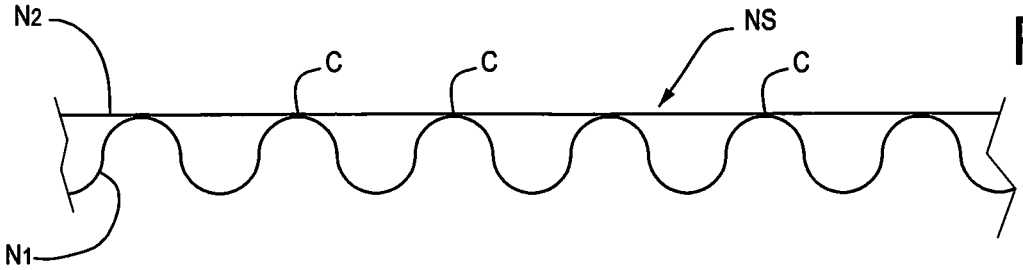
FIG. 2 illustrates schematically a single face corrugated web manufactured by a single facer of the manufacturing line of FIGS. 1A-1D.

A single face corrugated web NS is thus obtained at the exit side of the single facer 21. The single face corrugated web NS is formed by the first, corrugated paper web N1 and the second, smooth paper web N2, as shown in the enlargement of FIG. 2. The crests or flutes O formed on the first paper sheet N1 are glued by glue C, applied by the gluing unit 35 to the flutes O, onto the surface of the smooth paper web N2 facing the corrugated cardboard sheet N1.

Downstream of the single facer 21 a bridge 41 is arranged, which extends towards the section 5 and the following sections 7 and 9 of the manufacturing line 1. On the bridge 41 suitable length of single face corrugated web NS can be formed, with the formation of suitable accumulation folds, so that the operating speed of the single facer 21 can be made, at least partially, independent of the operating speed of the downstream sections.

The single face corrugated web NS is then fed along a first path which extends on the bridge 41 up to a heating roller 43, and therefrom to the double facer 8 in double facer section 9.

In the illustrated embodiment, the manufacturing line 1 comprises a second section 5, which can be similar or identical to the section 3, where a second single face corrugated web, again labeled NS, is formed starting from a further pair of smooth paper webs N4, N5 delivered by unwinders similar to unwinders 29 and 31. The paper webs N4, N5 are fed to a respective single facer 21. The second single face corrugated web NS is fed to the bridge 41 and is fed towards the double facer 8 in section 9.

In other embodiments, the section 5 and the respective single facer may be omitted. In further embodiments, vice versa, more than two sections 3, 5 may be provided, with respective single facer and unwinder, to produce respective single face corrugated webs NS, which are then glued together by in the double facer 8 of section 9.

A smooth paper board N3 is unwound from a further unwinder 47 and fed to double facer 8 in section 9. In a known manner, gluing units 51, 53 apply a glue onto the flutes of the respective corrugated sheet N1 the two single face corrugated webs NS, to glue them together and with the smooth paper web N3.

The section 9 and the double facer 8 can be configured in a known manner and will not be described in detail herein. Exemplary embodiments of double facers are disclosed in U.S. Pat. No. 7,291,243 and in US 2012/0193026.

In section 11 a transversal rotating shear 61 is arranged, which can transversely cut the corrugated board N fed from section 9, if needed. The corrugated board N, fed through the slitter-scorer section 13, is divided into strips which can be deviated along two paths defined by the two conveyors 17A, 17B of section 17. Section 13 can be configured in a known manner, for example as disclosed in U.S. Pat. Nos. 5,951,454, 6,165,117, 6,092,452, 6,684,749, 8,342,068.

The two conveyors 17A, 17B convey corrugated board sheets generated by transversally cutting the continuous strips of section 15, in order to form stacks P1, P2.

Each single face corrugated web NS is lifted, i.e. pulled, from the respective single facer 21 to the bridge 41 by means of a respective conveyor device 100 or lifting device 100, shown in a somewhat schematic way in FIGS. 1A, 1B and illustrated in more details in FIGS. 4-10 and described here on.

Each conveyor or lifting device 100 comprises a supporting structure 103 comprised of two side panels 105 and a framework of longitudinal beams and cross beams 107, 109. The supporting structure 103 can be mounted on bridge 41. The longitudinal beams 107 can form part of the bridge 41 or can be constrained thereto. The side panels 105 rotatingly support a first, lower guide roller 111 having a rotation axis 111A. The roller 111 and the rotation axis 111A thereof are oriented transversely with respect to the direction of advancement of the single face corrugated web NS lifted by the conveyor device 100 from the single facer 21 onto the bridge 41.

The side panels 105 further support an upper pair of nip members 113 forming a pinching and conveyance nip 119 for drawing or pulling the single face corrugated web NS from the lower motor-driven roller 111 towards the bridge 41. In particularly advantageous embodiments, the pair of nip members includes a pair of motor-driven rollers 113, comprised of a first roller 115 and a second roller 117. The pinching and conveyance nip 119 is formed between the first roller 115 and the second roller 117. The first roller 115 can be supported for rotation around a rotation axis 115A directly on the side panels 105. The second roller 117 is supported for rotation around a rotation axis 117A by two pivoting arms 121, hinged to the side panels 105 around a hinge axis 121A. Spring elements or actuators 123 act upon the pivoting arms 121 to bias the second roller 117 against the first roller 115, such that a nip pressure between the rollers 115, 117 is generated in the pinching and conveyance nip 119. The spring elements or actuators 123 can include cylinder-piston devices, for instance gas springs, or preferably pneumatic cylinder-piston actuators, which may be used to lift roller 117 from roller 115 when required.

In some embodiments the second roller 117 can include a plurality of resiliently yieldable discs 117D. The discs 117D can resiliently deform under the force applied by the actuators 123, such that rollers 115 and 117 will contact each other along an extended contacting area, thus forming an extended nip, for the purposes which will become clearer later on.

Figure 4:
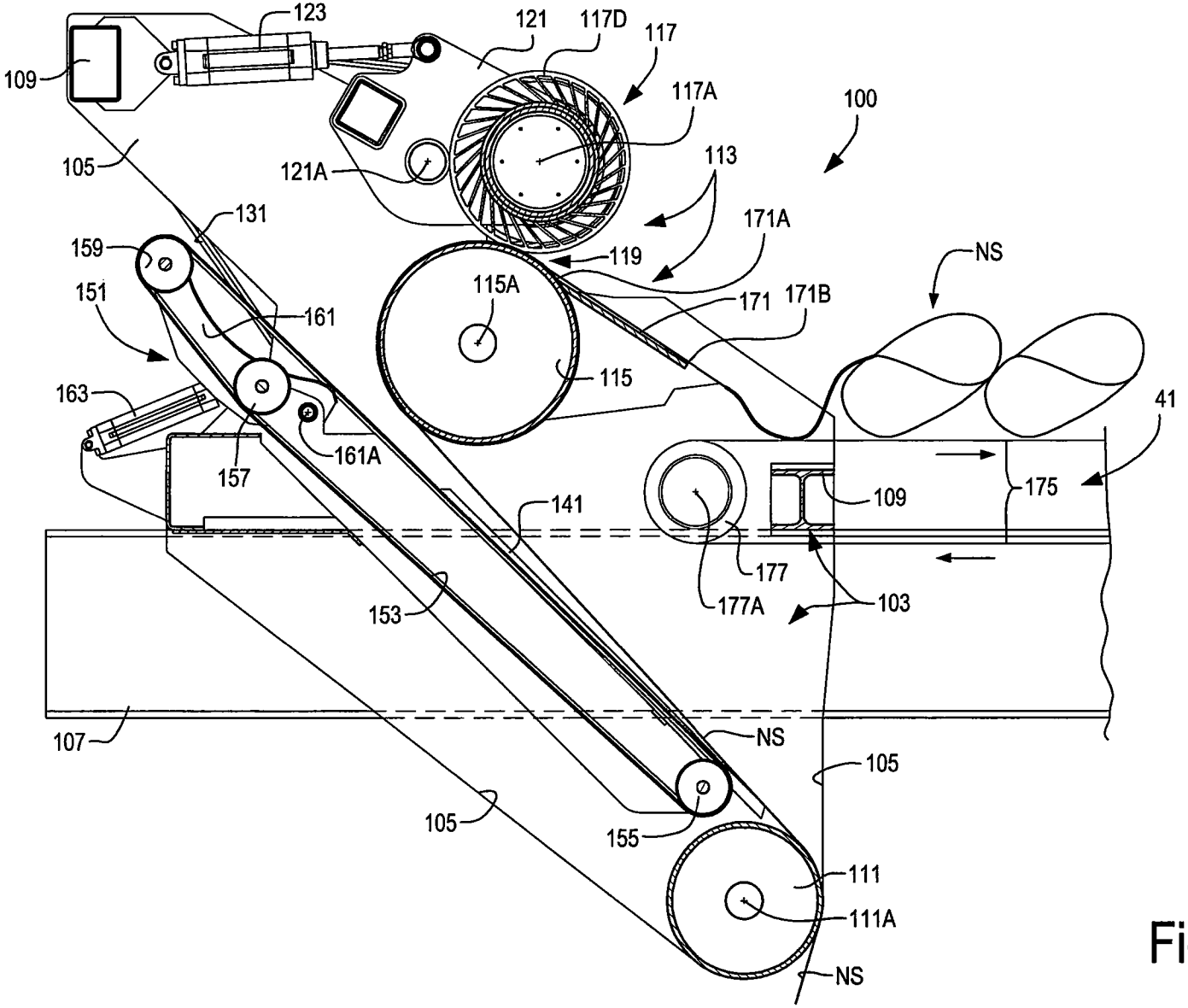
FIGS. 4 and 5 illustrate cross-sectional views of the conveyor device in two different operating conditions.
Figure 4A:
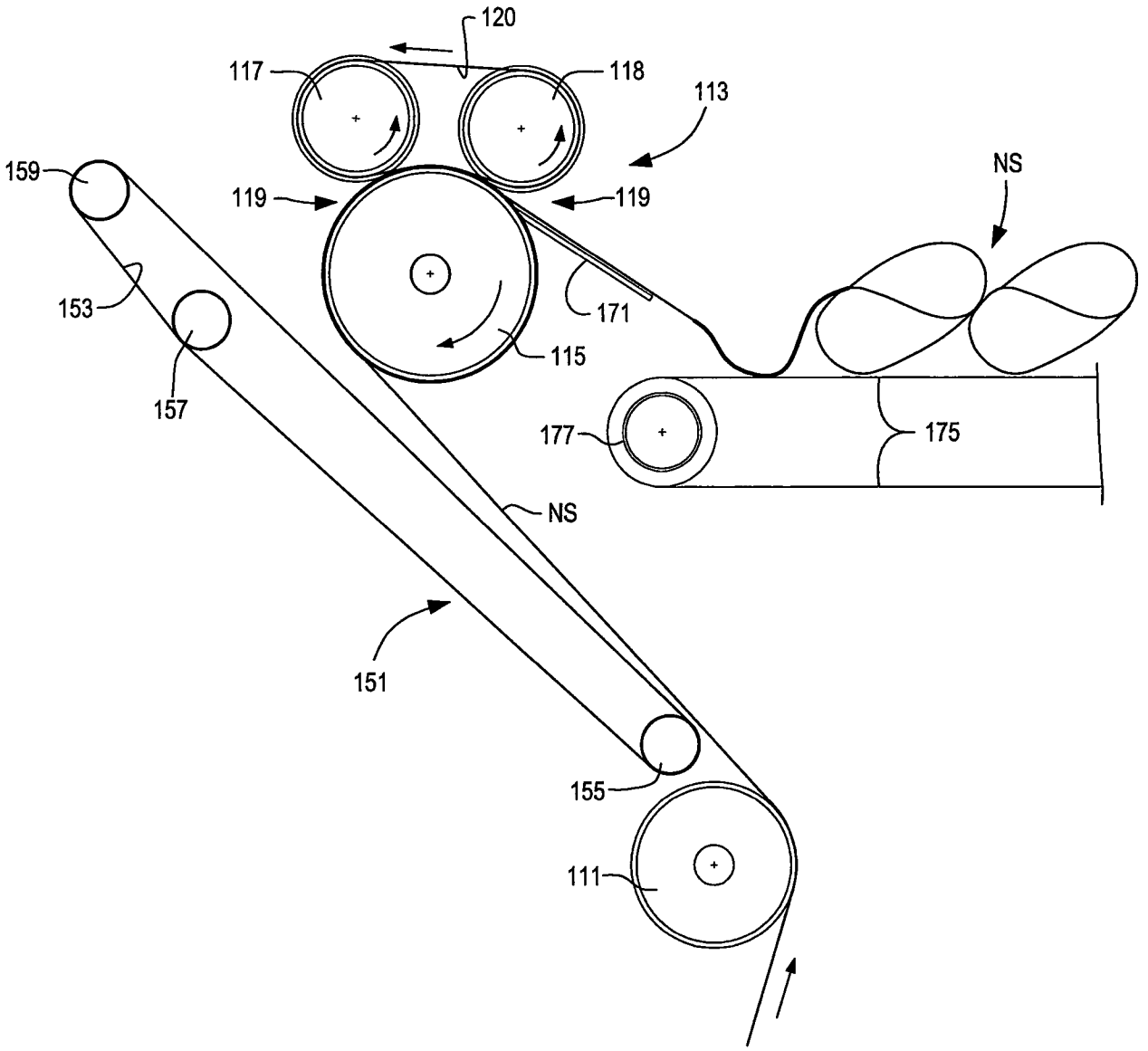
FIG. 4A illustrates a modified embodiment.

In another embodiment, an extended pinching and conveyance nip 119 can be formed by combining a third roller 118 with the upper pair of rollers 115, 117, as shown schematically in FIG. 4A. The rollers 117, 118 can be in pressure contact with roller 115 and a short endless belt or a plurality of short endless belts 120 can be entrained around rollers 117, 118. One of the two branches of belts 120 wraps around roller 115 by a rather small angle, such as for instance 30-60°, forming an extended pinching and conveyance nip 119, through which the single face corrugated web NP passes. In this embodiment, therefore the pinching and conveyance nip 119 is formed by a first nip member formed by roller 115 and by a second pinch member formed by the cluster of rollers 117, 118 and belt 120.

The lower guide roller 111 can be idle. In preferred embodiments, the lower guide roller 111 is motor-driven. Also the upper pair of rollers 115, 117 are motor-driven. In some embodiments, one of the upper rollers 115, 117 can be drivingly coupled to a driving motor while the other is rotated by friction. In preferred embodiments, however, both upper rollers 115, 117 are positively driven by a driving motor.

Figure 6:
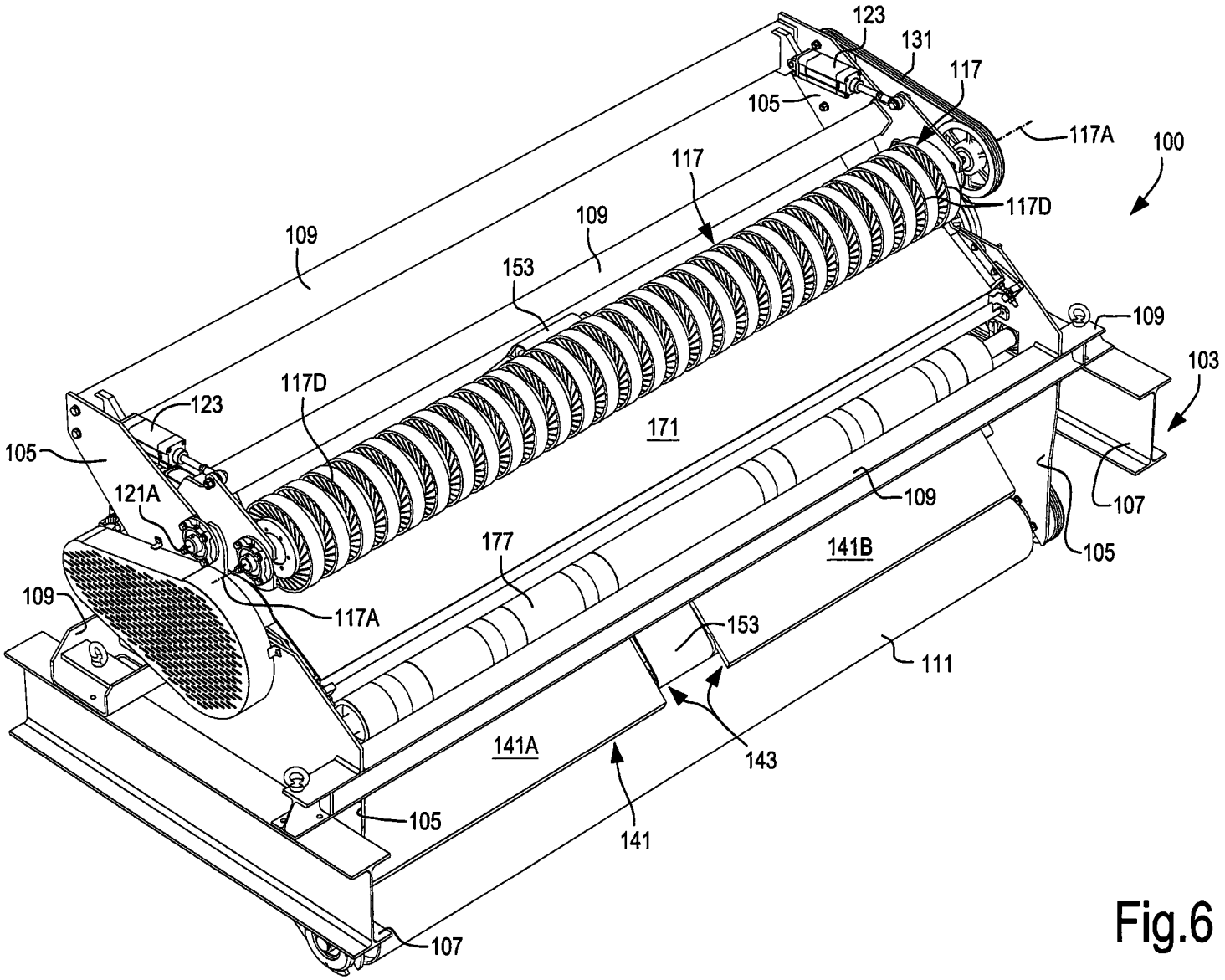
FIGS. 6 and 7 illustrate axonometric front views of the conveyor device of FIGS. 4 and 5.
Figure 7:
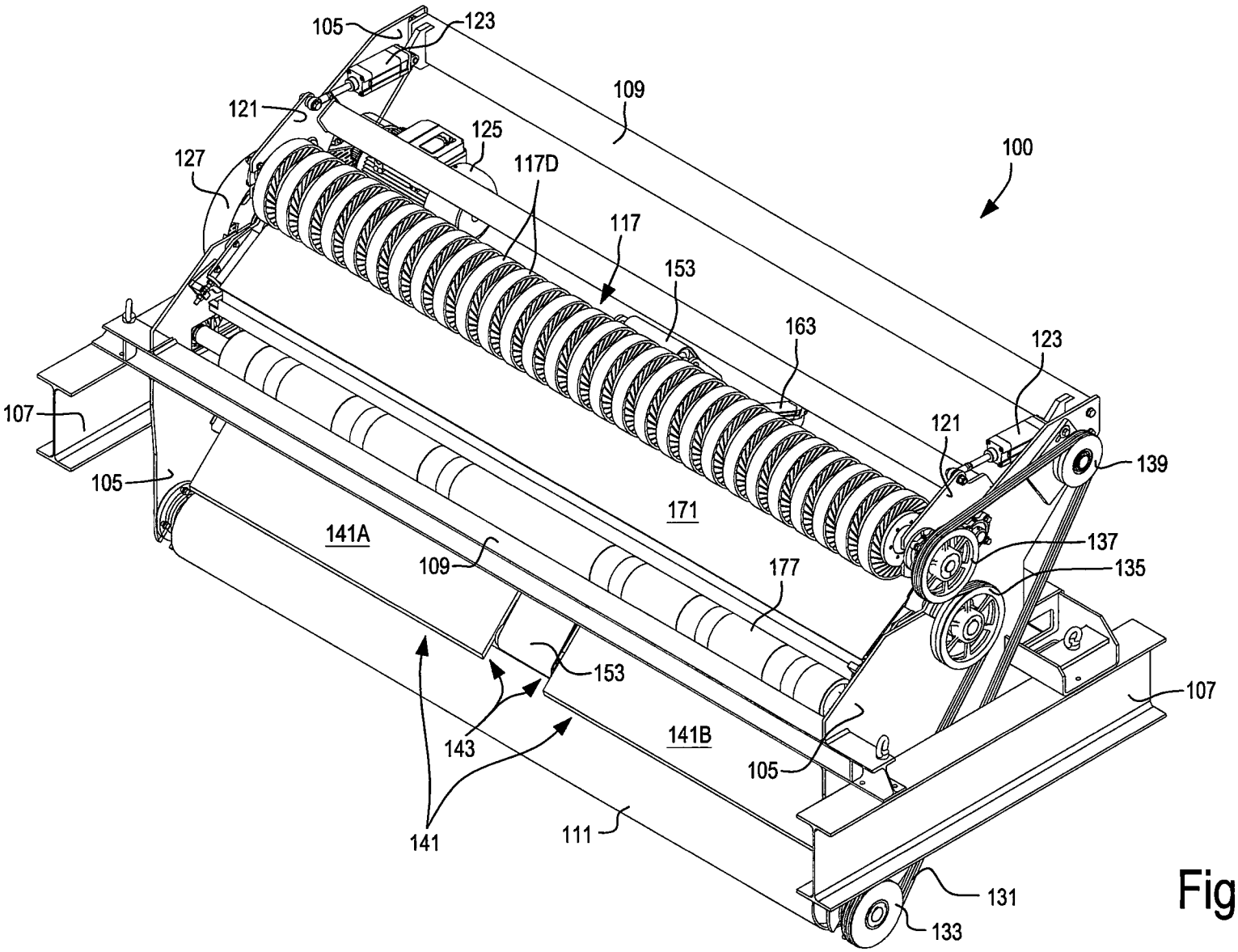
Figure 8:
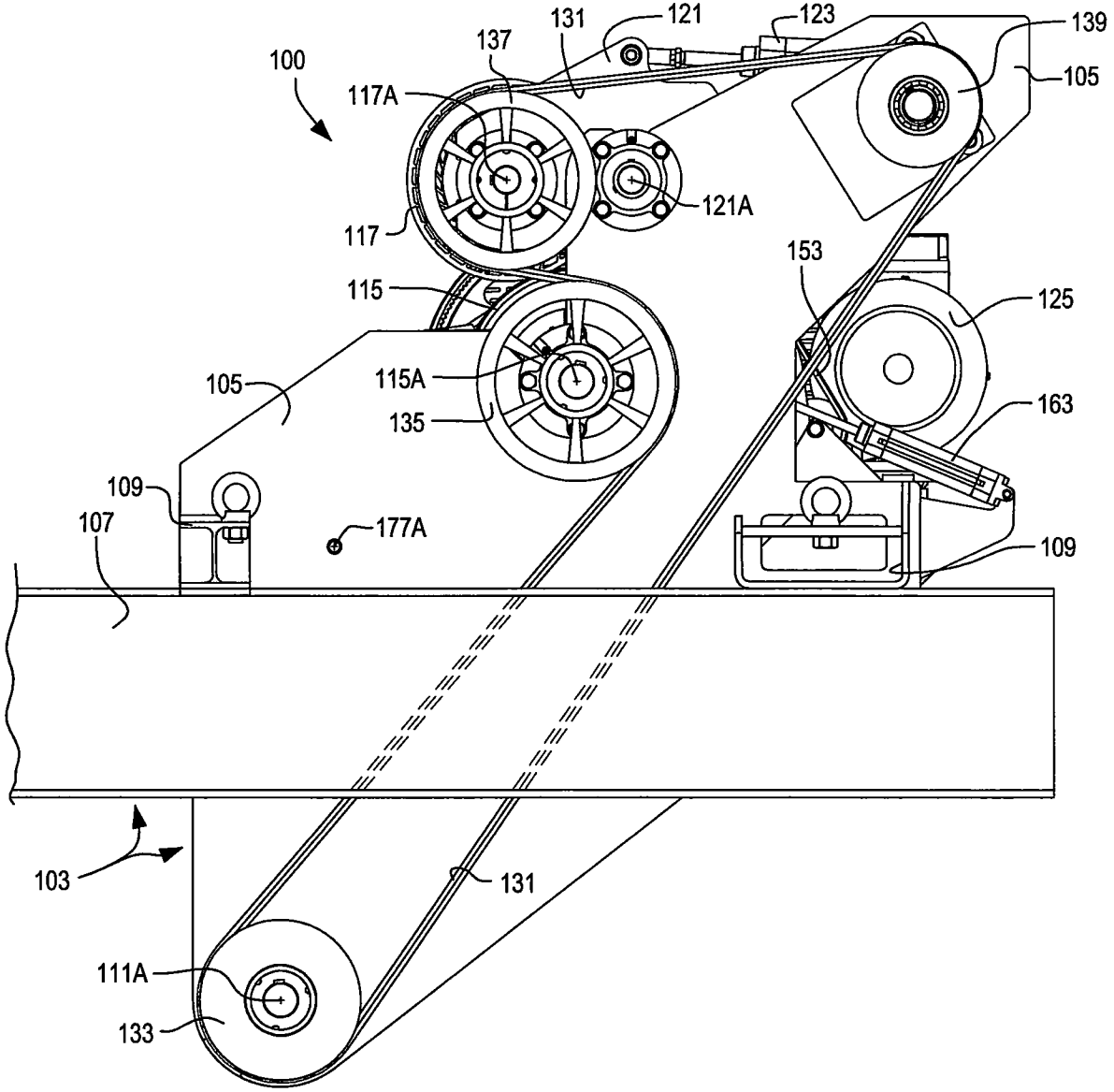
FIG. 8 illustrates a side view of the conveyor device of FIGS. 4 and 5.
Figure 9:
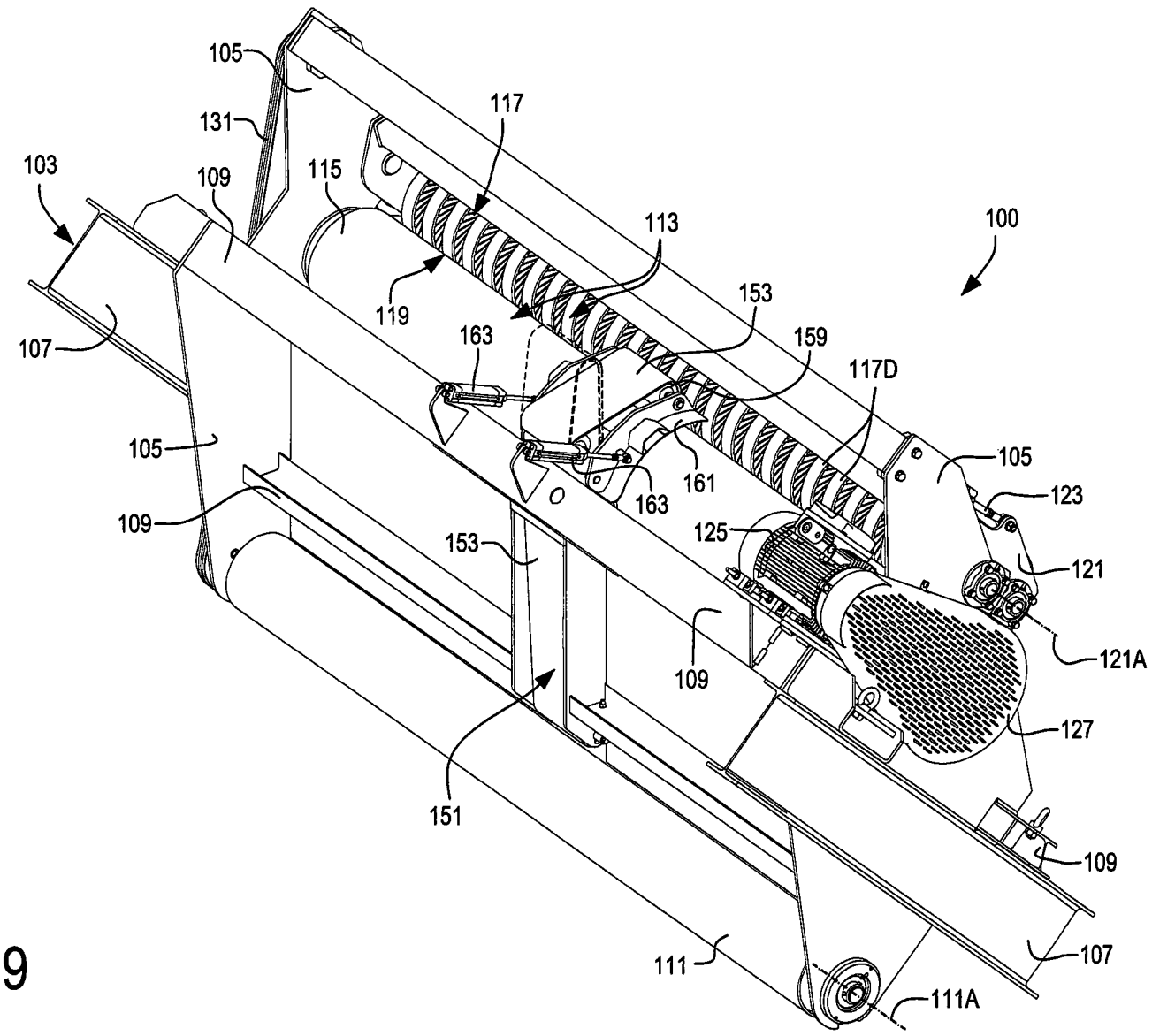
FIG. 9 illustrates an axonometric back view of the conveyor device of FIGS. 4 and 5.
Figure 10:
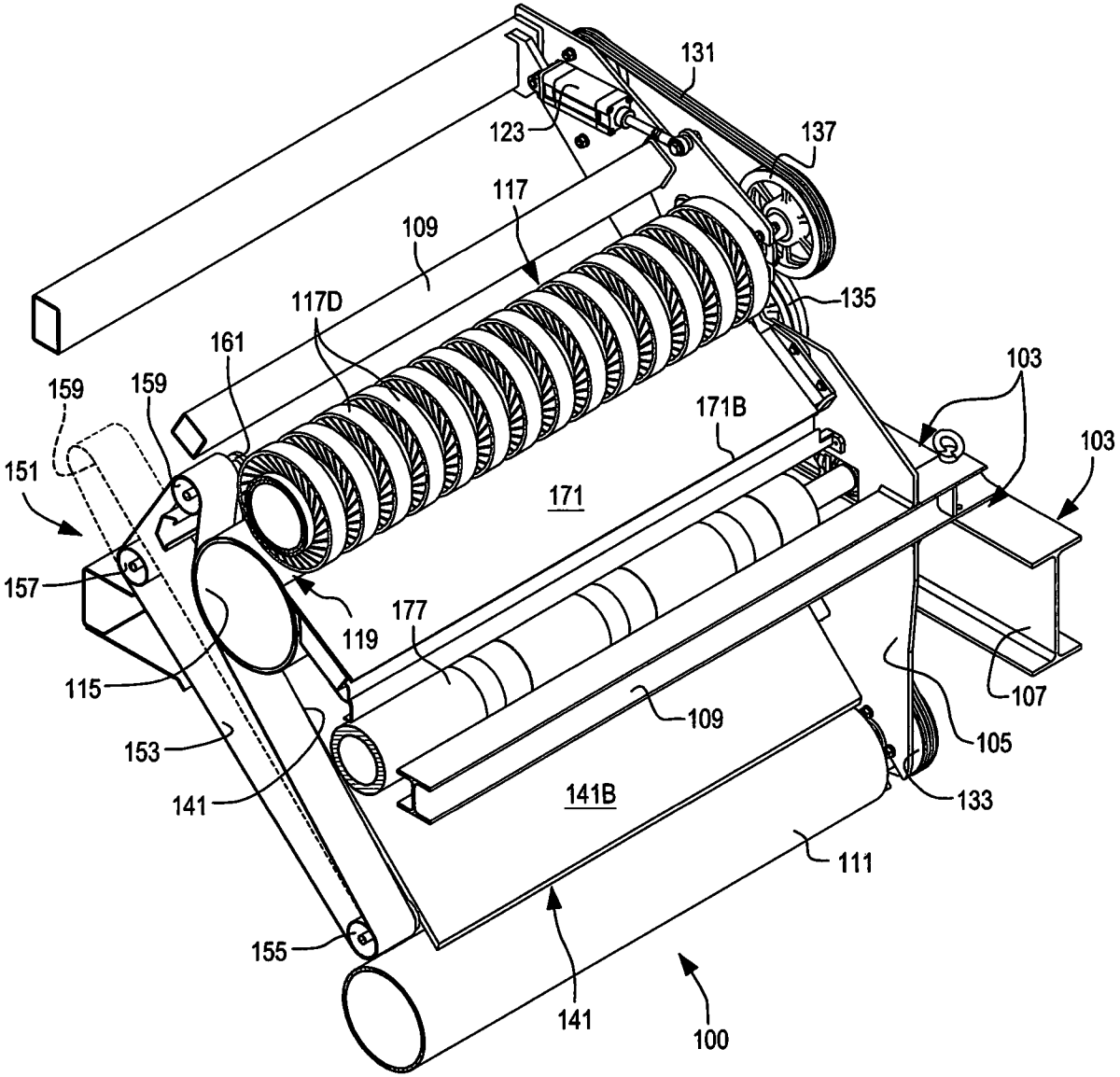
FIG. 10 illustrates a fragmentary axonometric view of the conveyor device of FIGS. 4 and 5.

According to some embodiments, not shown, two or three separate motors can be used to independently drive the rollers 111, 115, 117. In other embodiments, as shown in the drawings, a single motor 125 is use to drive into rotation all three rollers 111, 115, 117. The motor 125 can be mounted on one of the cross beams 109 and can be drivingly coupled to roller 115, for instance through a belt and a pulley, not shown and housed in a protecting guard 127 (FIGS. 6, 9). The motor 125 can be an electric motor. In other embodiments, a hydraulic motor or another kind of mover can be used, instead.

On the side opposite to motor 125 driving members can be provided, which drivingly connect the rollers 111, 115 and 117 to one another. In some embodiments, see in particular FIGS. 7 and 8, the driving members comprise an endless flexible member 131, such as a belt. In some embodiments, the endless flexible member 131 can be entrained around a first pulley 133, which is keyed on roller 111, around a second pulley 135 keyed on roller 115, around a third pulley 137 keyed on roller 117, as well as around a fourth pulley 139. The three rollers 111, 115, 117 thus rotate synchronously each at a suitable peripheral speed, which depends upon the diameter of the rollers and of the pulleys around which the endless flexible member is guided. In some embodiments the roller and pulley diameters can be selected such that the upper rollers 115, 117 rotate at a peripheral speed which is slightly higher than the peripheral speed of the lower roller 111. For instance the peripheral speed of the upper rollers 115, 117 can be 1-2% higher than the peripheral speed of roller 111.

Between the lower motor-driven roller 111 and the motor-driven roller 115 a stationary slide 141 can be provided. The slide 141 can be rigidly connected to the side panels 105 and supported thereby and/or by cross beams 109 of the supporting structure 103. The slide 141 can be formed by a panel or by a pair of co-planar panels 141A, 141B. A slot 143 can be machined in the panel, if the slide 141 is formed by a single panel. If two panels 141A, 141B are provided, a gap 143 can be provided between the two panels 141A, 141B. The gap 143 forms a slot which extends in a direction of advancement of the single face corrugated web NS as will be described in more detail here below, from the lower motor-driven guide roller 111 towards the upper motor-driven roller 115. The surface of slide 141 facing towards the rollers 111, 115 and 117 form a guide surface for the single face corrugated web NS in some operating conditions, as will be described later on. In normal steady state conditions, however, when the single face corrugated web NS is continuously fed by the single facer 21, the single face paper web NS preferably forms a free span of web extending from the lower motor-driven roller 111 to the upper roller 115. This span of single face corrugated web NS preferably moves freely without being in contact with any guiding or driving member. The traction force required to lift the single face corrugated web NS from the single facer 21 to the bridge 41 is imparted by the rollers 115, 117 and by roller 111, if this latter is motor-driven.

Behind the slide 141, i.e. on the side thereof opposite rollers 111, 115, 117, a web threading device 151 is arranged. As will be described later on, the web threading device 151 can be used for threading the leading edge of a new single face corrugated web NS through the conveyor device 100.

In some embodiments the web threading device 151 comprises an endless member 153, for instance a belt. The belt 153 is entrained around three idle threading rollers 155, 157, 159. The belt 151 is relatively narrow. As can best be seen in FIG. 6, for instance, the belt 151 is as large as the slot 143, or slightly narrower than the slot 142, i.e. it has a width which is only a fraction of the axial length of rollers 111, 115, 117. As can be appreciated from FIG. 4, for instance, the belt 153 is arranged in front of the surface of the single face corrugated web NS which contacts the lower, motor-driven guide roller 111, i.e. it is arranged underneath the single face corrugated web NS.

The idle threading rollers 155, 157 can be mounted on the supporting structure 103 in a fixed position, while idle guide roller 159 has a movable axis. In some embodiments, the idle guide roller 159 can be supported by a pair of pivoting arms 161, which are hinged at 161A to the supporting structure 103. One or two actuators 165 (see e.g. FIGS. 4, 5, 9) are provided to control the pivoting movement of arms 161 around pivoting axis 161A with respect to the supporting structure 103.

Figure 5:
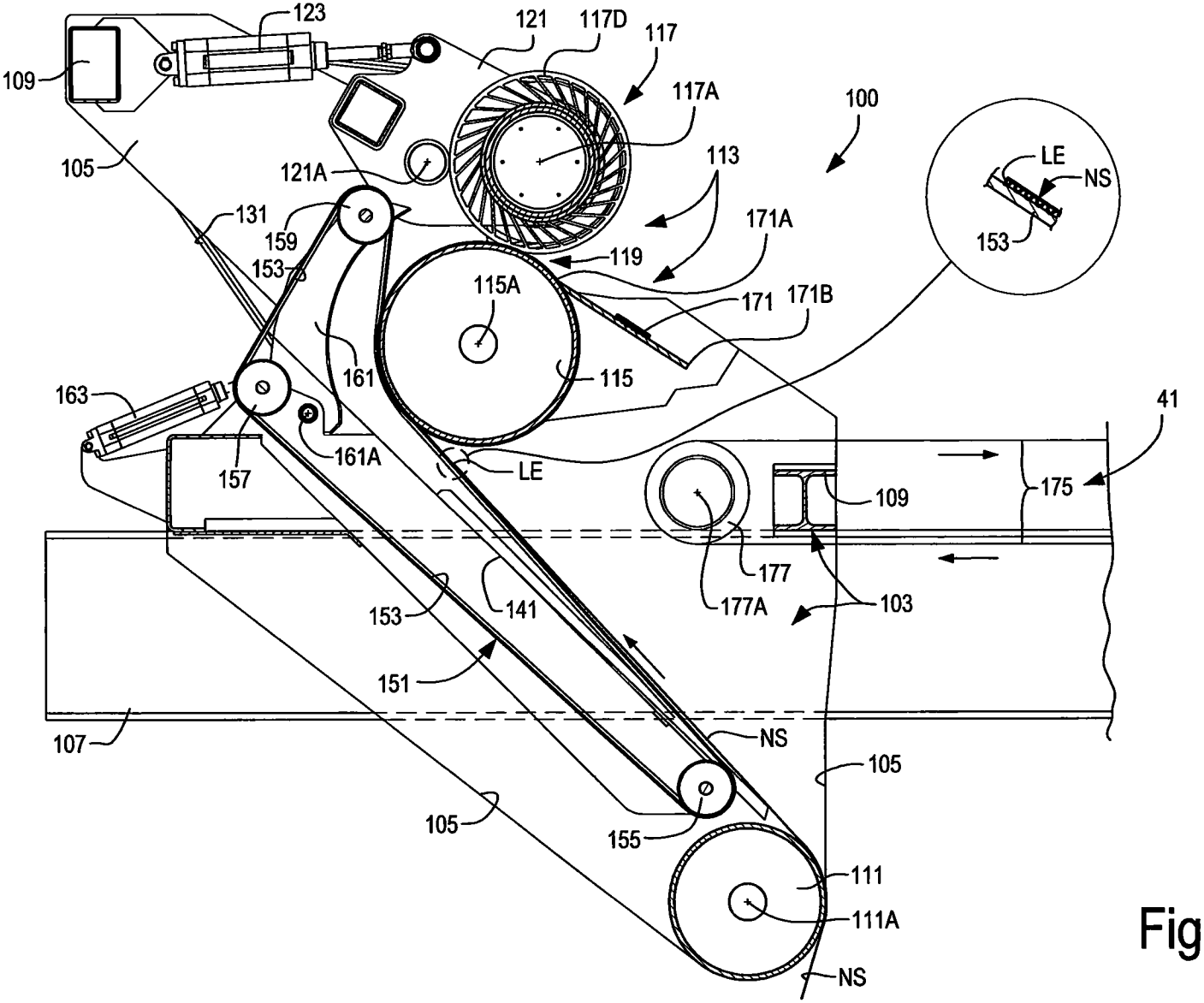

The endless belt 153 can take two alternative positions, best shown in FIGS. 4 and 5. In FIG. 4 the web threading device 151 is in an idle position, wherein the pivoting arms 161 are placed in a retracted position, such that the idle roller 159 is distanced from the roller 115. The endless belt 153 forms a rectilinear upper branch extending from the lower threading roller 155 to the upper roller 159, such that the belt 153 is clear of the roller 115. In the active position of the web threading device 151, shown in FIG. 5, the pivoting arms 161 are rotated towards the pinching and conveyance nip 119 such that the belt portion between the idle threading roller 155 and the idle roller 159 wraps around the motor-driven roller 115 of the upper motor-driven roller pair 113. The slot 143 provided in the slide 141 allows the belt 153 to project outside the stationary slide 141 towards the roller 115. As will be described in greater detail later on, in this position threading of the single face corrugated web NS through the pinching and conveyance nip 119 is facilitated.

In some embodiments, a chute 171 is mounted between the two side panels 105. The chute 171 has a leading edge 171A extending adjacent the cylindrical surface of roller 115 and parallel to the axis 115 thereof (see FIGS. 4, 5). The chute 171 further has a trailing edge 171B, parallel to the leading edge 171A and arranged at a lower height than the leading edge 171A. The chute 171 guides the single face corrugated web NS from the pinching conveyance nip 119 towards an endless conveyor 175, which extends along the bridge 41. The endless conveyor 175 can be entrained around a roller 177 supported by side panels 105 and rotating around a rotation axis 177A. The roller 177 can be idly mounted on the side panels 105. The endless conveyor 175 can be guided around a further roller, not shown, which can be motor-driven, such as to advance the endless conveyor 175 along bridge 41 and move the single face corrugated web NS from the conveyor device 100 towards the double facer 8.

The conveyor device 100 described so far operates as follows.

Figure 3:
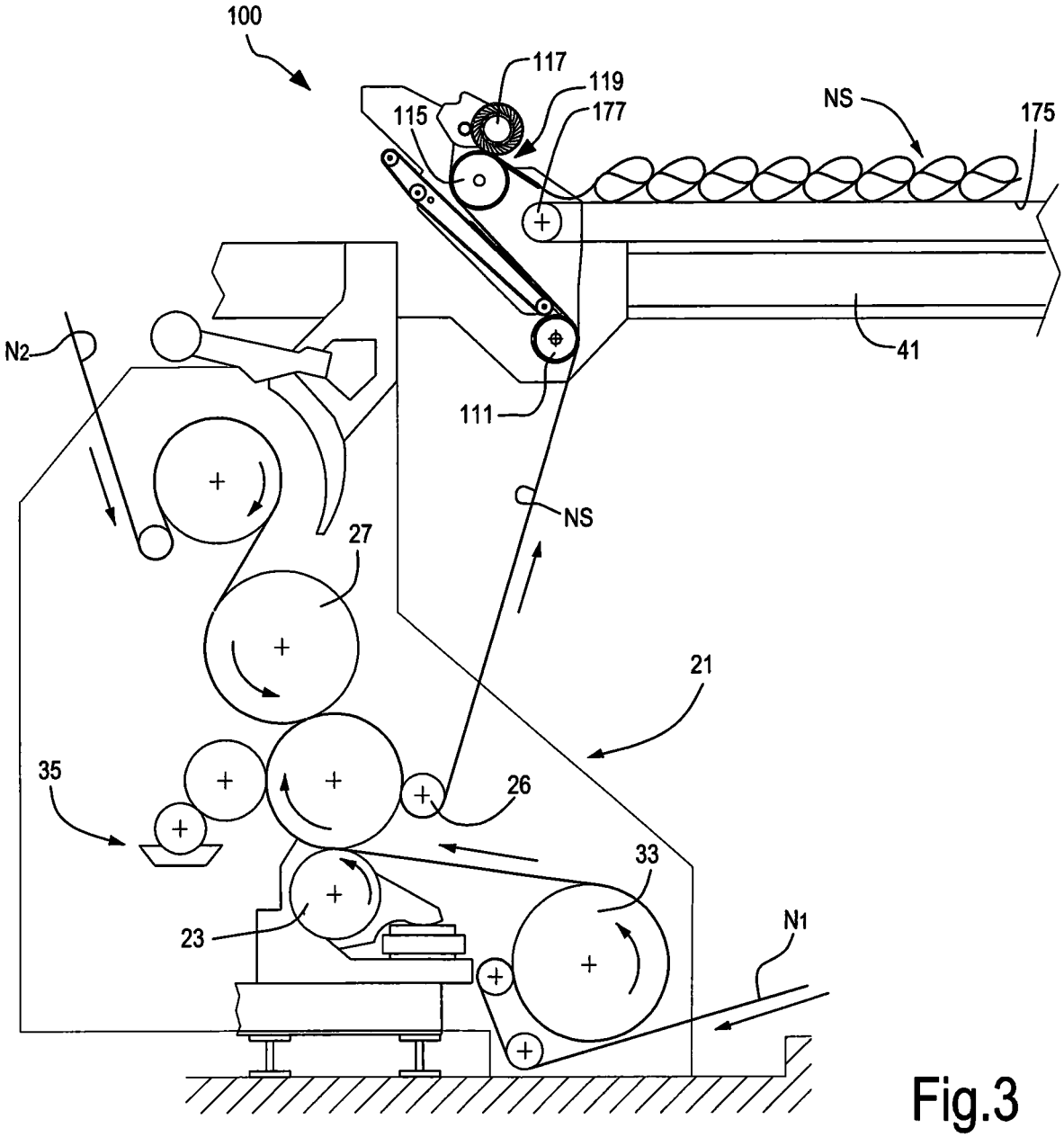
FIG. 3 illustrates an enlargement of a single facer of the line shown in FIGS. 1A-1D and relevant conveyor device moving the single face from the single facer to the bridge.

During normal operation of the manufacturing line 1, a single face corrugated web NS is continuously delivered by the single facer 21 and is conveyed by the conveyor device 100 towards and onto the bridge 41. The single face corrugated web NS wraps the lower motor-driven roller 111, as best shown in FIGS. 3 and 4, while in the remaining figures the single face corrugated web NS is not shown for the sake of clarity. The lower motor-driven guide roller 111 may have a cylindrical outer surface coated with a material having a high coefficient of friction, such as rubber. As used herein, the term high coefficient of friction can be understood as a coefficient of friction suitable to transmit a traction force to the single face corrugated web NS which wraps roller 111.

Downstream of the lower, motor-driven roller 111, the path of the single face corrugated web NS extends around the motor-driven roller 115 and partly wraps it, to enter the pinching and conveyance nip 119. The span of single face corrugated web NS between the lower motor-driven guide roller 111 and the upper motor-driven roller 115 moves freely and clear of any driving or guiding member, even though use of sliding or guiding elements, such as idle rollers, sliding bars or the like, is not excluded. However, in advantageous embodiments, this portion of the path of advancement of the single face corrugated web NS between the lower motor-driven roller 111 and the upper motor-driven roller 115 is not in contact with moving belts.

In the pinching and conveyance nip 119 the single face corrugated web NS is pinched between the motor-driven roller 115 and the motor-driven roller 117. The rotation torque applied by motor 125 to the motor-driven rollers 115, 117 and the friction between these latter and the single face corrugated board NS generate a traction force on the single face corrugated board NS to promote the advancement thereof towards the bridge 41. The yielding structure of the motor-driven roller 117 forms an extended nip, such that a relatively large area of contact of the single face corrugated board NS with the motor-driven roller 115 and the motor-driven roller 117 is maintained, to increase the traction force applied to the advancing single face corrugated web NS.

At the exit of the pinching and conveyance nip 119 the single face corrugated web NS slides along the chute 171 and moves towards the advancing endless conveyor 175. This latter advances the single face corrugated web NS towards the double facer 8. The bridge 41 forms a storage of single face corrugated web NS, which is collected in a wavy manner on the endless conveyor 175.

During this steady state operation the web threading device 151 is idle, i.e. in the position of FIG. 4 and the endless belt 153 is clear of the single face corrugated board NS and of the motor-driven roller 115.

When no single face corrugated web NS is present in the conveyor device 100 and a new leading portion of single face corrugated web NS must be threaded through the conveyor device 100, the web threading device 151 is moved in its operating position shown in FIG. 5. The actuators 163 swing the pivoting arms 161 forwards toward the motor-driven roller 115, such that the endless belt 153 partially wraps the motor-driven roller 111. When the motor 125 is energized, the rollers 111, 115, 117 are driven into rotation. The friction between the roller 115 and the endless belt 153 causes this latter to be driven in motion as well. The operator can push the leading edge of the single face corrugated web NS around the motor-driven roller 111, along the slide 141 and along the endless belt 153. The leading edge LE of the single face corrugated web (see FIG. 5) approaches the nip between the roller 115 and the belt 153. Once the single face corrugated web NS is pinched by the endless belt 153 against the motor-driven roller 115, the friction of the endless belt 153 and of the roller 115 will promote the advancement of the single face corrugated web NS until the leading edge thereof enters the pinching and conveyance nip 119 and lastly emerges therefrom and reaches the bridge 41.

The above described conveyor device avoids the need for a pair of conveyor belts pressed one against the other and extending for the full width of the single face corrugated web, as used in some corrugated board manufacturing lines of the current art. Control problems relating to the conveyor belts are eliminated. Additionally, threading of the leading edge of a single face corrugated web at startup is easy and safe, as the operator does not have to approach pinching devices.

While the invention has been described in terms of various specific embodiments, it will be apparent to those of ordinary skill in the art that many modifications, changes, and omissions are possible without departing form the spirt and scope of the claims. In addition, unless specified otherwise herein, the order or sequence of any process or method steps may be varied or re-sequenced according to alternative embodiments.

What is claimed is:

1. A conveyor device for conveying a single face corrugated web on a bridge, comprising:

a lower guide roller, around which the single face corrugated web is guided;

an upper pinching and conveyance nip formed by a pair of nip members in pressure contact with one another, at least one of said pair of nip members being motor-driven; the upper pinching and conveyance nip being configured to pull the single face corrugated web upwards from the lower guide roller; and a corrugated web threading device adapted to thread a leading portion of the single face corrugated web into the upper pinching and conveyance nip.

2. The conveyor device of claim 1, wherein the pair of nip members and the lower guide roller are arranged such that the single face corrugated web running through the conveyor device forms a free span between the lower guide roller and the upper pinching and conveyance nip.

3. The conveyor device of claim 1, wherein the pair of nip members comprises a pair of rollers, and wherein at least one of said pair of rollers is motor-driven.

4. The conveyor device of claim 3, wherein both rollers of the pair of rollers are motor-driven.

5. The conveyor device of claim 1, wherein the lower guide roller is motor-driven.

6. The conveyor device of claim 5, comprising a single motor and an endless flexible member drivingly connecting the motor, the lower guide roller and the pair of nip members forming the upper pinching and conveyance nip.

7. The conveyor device of claim 1, wherein the corrugated web threading device is adapted to wrap the single face corrugated web around one of the pair of nip members.

8. The conveyor device of claim 7, wherein the corrugated web threading device comprises an endless member driven along a closed path; wherein the closed path is adapted to take selectively an idle position and a web threading position; and wherein in the idle position the endless member is clear of the pair of nip members, and in the web threading position the endless member is wrapped around at least one of said pair of nip members.

9. The conveyor device of claim 8, wherein the endless member is driven around a plurality of threading rollers; wherein at least one of said plurality of threading rollers has a movable axis and is adapted to move from the idle position to the web threading position and vice-versa.

10. The conveyor device of claim 9, wherein the plurality of threading rollers are idle rollers.

11. The conveyor device of claim 8, wherein the lower guide roller, the pair of nip members and the endless member of the corrugated web threading device are arranged such that the endless member is positioned between the lower guide roller and the pair of nip members and faces a side of the single face corrugated web which contacts the lower guide roller.

12. The conveyor device of claim 8, wherein a slide is arranged between the lower guide roller and the pair of nip members; wherein the slide has a slot extending along a direction of advancement of the single face corrugated web from the lower guide roller to the pair of nip members; and wherein in the web threading position the endless member is adapted to project through the slot towards the pair of nip members.

13. The conveyor device of claim 1, further comprising pressure members adapted to press the pair of nip members one against the other; and wherein at least one of said pair of nip members is adapted to pivot around an axis parallel to rotation axes of said nip members.

14. A corrugated web manufacturing line, comprising:

at least one single facer;

a double facer;

a bridge extending from the at least one single facer to the double facer, adapted to convey a single face corrugated web from the at least one single facer to the double facer;

a conveyor device, to convey a single face corrugated web from the at least one single facer to the bridge; and a corrugated web threading device;

wherein the conveyor device comprises: a lower guide roller, around which the single face corrugated web is guided; and an upper pinching and conveyance nip formed by a pair of nip members in pressure contact with one another, at least one of said pair of nip members being motor-driven; the upper pinching and conveyance nip being configured to pull the single face corrugated web upwards from the lower guide roller; and wherein said corrugated web threading device is adapted to thread a leading portion of the single face corrugated web into the upper pinching and conveyance nip.

15. A method of operating a corrugated board manufacturing line comprising steps as follows:

continuously manufacturing a single face corrugated web in a single facer;

pulling the single face corrugated web from the single facer onto a bridge by a conveyor device, said conveyor device comprising: a lower guide roller; and an upper pinching and conveyance nip formed by a pair of nip members in pressure contact with one another, at least one of said pair of nip members being motor-driven; wherein the single face corrugated web is lifted from the single facer to the bridge by action of at least said pair of nip members;

advancing the single face corrugated web on the bridge towards a double facer; and wherein said method further comprises threading a leading portion of the single face corrugated web through the upper pinching and conveyance nip by a web threading device.

16. The method of claim 15, wherein the lower guide roller is motor driven, and wherein the single face corrugated web is pulled from the single facer towards the bridge by combined action of nip members and of the lower guide roller which is motor-driven.

17. The method of claim 15, wherein the threading of the leading portion of the single face corrugated web comprises advancing the leading portion of the single face corrugated web towards the upper pinching and conveyance nip; wrapping the leading portion of the single face corrugated web around one of said pair of nip members; advancing the leading portion of the single face corrugated web into the upper pinching and conveyance nip.

18. The method of claim 15, wherein the threading of the leading portion of the single face corrugated web comprises temporarily wrapping an endless member around one of said pair of nip members and introducing the leading portion of the single face corrugated web between the endless member and said one of said pair of nip members.

* * * * *